US008241723B2

(12) United States Patent
Schneider et al.

(10) Patent No.: US 8,241,723 B2
(45) Date of Patent: Aug. 14, 2012

(54) APPARATUS FOR PROVIDING A FLEXIBLE EXTERNAL SURFACE SHIELD ON A RECREATIONAL BOARD

(76) Inventors: Matthew R. Schneider, Chino, CA (US); Barbara J. Jones, Fontana, CA (US)

( * ) Notice: Subject to any disclaimer, the term of this patent is extended or adjusted under 35 U.S.C. 154(b) by 906 days.

(21) Appl. No.: 12/204,212

(22) Filed: Sep. 4, 2008

(65) Prior Publication Data

US 2010/0055379 A1 Mar. 4, 2010

(51) Int. Cl.
*B32B 1/04* (2006.01)
*B23P 19/08* (2006.01)

(52) U.S. Cl. ..... 428/99; 280/87.041; 428/98

(58) Field of Classification Search ..... 428/98, 428/99; 280/87.04, 87.041
See application file for complete search history.

(56) References Cited

U.S. PATENT DOCUMENTS

2003/0201636 A1* 10/2003 McCoy ..... 280/814
2004/0056060 A1* 3/2004 Iannini et al. ..... 224/602

* cited by examiner

*Primary Examiner* — Brent Ohern
(74) *Attorney, Agent, or Firm* — Patent Venture Group; Joe A. Brock, II

(57) ABSTRACT

An invention is provided for a flexible external surface shield for use while operating a recreational board. An embodiment of the invention includes a shaped material having an outer edge, an upper surface, and a lower surface. Also included is a casting, which is formed along the outer edge and includes a stretchable material capable of creating an inward force on the casting such that the casting forms an edge of an underside opening partially enclosing the lower surface of the shaped material. Further included is a plurality of fasteners disposed across the underside opening. The fasteners prevent the underside opening from enlarging beyond a predetermined size when the fasteners are engaged.

10 Claims, 6 Drawing Sheets

APPARATUS FOR PROVIDING A FLEXIBLE EXTERNAL SURFACE SHIELD ON A RECREATIONAL BOARD

BACKGROUND OF THE INVENTION

1. Field of the Invention

This invention relates generally to recreational boards, and more particularly to apparatuses for providing material surfacing for recreational boards.

2. Description of the Related Art

Skateboards provide an athletic experience similar to surfing in which the rider stands on the surface of the skateboard and directs the movement of the skateboard along a firm surface, such as asphalt. A typically skateboard generally includes a 6-12 inch wide board or platform to stand upon that is 2-3 feet long. Skateboards often are made of wood or fiberglass materials, for example, using a plurality of plies of sugar maple veneers, pressed together using polyvinyl glues. The veneers and glue that make up a board are pressed together in a press between forms of aluminum, metal or concrete, which allow for boards with various three dimensional shapes to be pressed together.

In addition, a skateboard typically includes two trucks and four wheels. Skateboards often include wheels frequently comprised of polyurethane or other relatively soft rubber compounds. A truck assembly includes a truck and two wheels, wherein each truck generally includes a pivoting assembly with a single or split axle. Each truck assembly is mounted on the bottom side of the board, with one truck assembly attached toward the front end of the skateboard and the other truck assembly attached toward the rear end of the skateboard.

As mentioned above, a skateboard is operated by a rider standing on the surface of the skateboard and directing the movement of the skateboard along a firm surface, such as asphalt. To allow for greater traction during use, skateboards often include an adhesive backed friction-surface material known as grip tape attached to the top surface of the skateboard. The grip tape provides additional friction, which provides a rider greater control of the board.

The ease of use of a skateboard often leads to users utilizing skateboards as vehicles to travel short distances. For example, skateboards often are utilized for recreation and short travel distances near a beach or swimming pool. However, because of the great flexibility provided by modern skateboards, skateboards often are used during summer recreation when a rider is potentially barefoot. For example, when used at the beach or by a pool a rider often is barefoot because of the nearby potential swimming opportunity. Yet, when left in the sun too long, the temperature of the grip tape can greatly increase as the sun's rays heat the grip tape and skateboard.

Generally, the grip tape on a skateboard is black, which further leads to intolerable skateboard temperatures when left in the sun. Moreover, when a rider is barefoot the added friction of the grip tape can be uncomfortable on the rider's feet. Yet, in general, it is desirable to include grip tape on a skateboard to increase board control when used while wearing appropriate footwear, such as deck shoes.

In view of the foregoing, there is a need for a mechanism that allows a skateboard to be safely and comfortable used by a barefoot rider. The mechanism should allow for comfort and heat protection, yet still provide an attractive board surface. Moreover, the mechanism should be designed to allow a rider having appropriate footwear to utilize the board in the same manner or to take full advantage of the grip tape disposed on the surface of the skateboard.

SUMMARY OF THE INVENTION

Broadly speaking, embodiments of the present invention address these needs by providing a flexible external surface shield that allows a skateboard to be safely and comfortable used by a barefoot rider, allowing for comfort and heat protection and providing an attractive board surface. In one embodiment, a flexible external surface shield for use while operating a recreational board is disclosed that includes a shaped material having an outer edge, an upper surface, and a lower surface. Also included is a casting, which is formed along the outer edge and includes a stretchable material capable of creating an inward force on the casting such that the casting forms an edge of an underside opening partially enclosing the lower surface of the shaped material. Further included is a plurality of fasteners disposed across the underside opening. The fasteners prevent the underside opening from enlarging beyond a predetermined size when the fasteners are engaged. For example, in one aspect the stretchable material can be an elastic band and the fasteners can be hook and loop fasteners. To provide extra comfort and durability, the shaped material can comprise a terrycloth fabric.

A further flexible external surface shield for use while operating a recreational board is disclosed in an additional embodiment of the present invention. Similar to above, a shaped material having an outer edge, an upper surface, and a lower surface is included. Formed along the outer edge is a casting that includes a pull cord capable of creating an inward force on the casting when placed in a tightened position. Similar to above the casting forms an edge of an underside opening partially enclosing the lower surface of the shaped material. In addition, a plurality of fasteners is disposed across the underside opening. The fasteners prevent the underside opening from enlarging beyond a predetermined size when the fasteners are engaged. To provide additional protection from contact with wheels during operation, wheel protectors can be included that are disposed in a vicinity of wheels when utilized with a skateboard. Each wheel protector prevents a portion of damage from wheels contacting the flexible external surface shield. For example, in one aspect, each wheel protector is formed from a boning material.

In an additional embodiment, a method for making a flexible external surface shield for use while operating a recreational board is disclosed. The method includes forming a basic shape from a pre-selected fabric, where the basic shape has an outer edge, an upper surface, and a lower surface. In general, the basic shape is based on a shape of a target board. The method also includes forming a casting about the outer edge, where the casting includes a stretchable material capable of creating an inward force on the casting. Similar to above, the casting forms an edge of an underside opening partially enclosing the lower surface of the basic shape. In addition, fasteners are attached across the underside opening such that the fasteners are capable of preventing the underside opening from enlarging beyond a predetermined size when the fasteners are engaged. In one aspect, the outer edge of the basic shape can be serge stitched, and a plurality of wheel protectors can be formed of in a vicinity of wheels when utilized with a skateboard. As above, each wheel protector prevents a portion of damage from wheels contacting the A flexible external surface shield, and can be formed from a boning material.

In this manner, embodiments of the present invention provide a surface to allow a skateboard to be safely and comfortable used while by a barefoot rider. The flexible external surface shield of the embodiments of the present invention allows for comfort and heat protection and provides an attractive board surface that can be easily applied and removed to allow riders having appropriate footwear to take full advantage of grip tape or other friction-surface material disposed on the surface of the skateboard. Other aspects and advantages of the invention will become apparent from the following detailed description, taken in conjunction with the accompanying drawings, illustrating by way of example the principles of the invention.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE PREFERRED EMBODIMENTS

An invention is disclosed for a flexible external surface shield that allows a skateboard to be safely and comfortable used by a barefoot rider. The flexible external surface shield allows for comfort and heat protection and provides an attractive board surface. Moreover, the flexible external surface shield is removably attached to allow riders having appropriate footwear to take full advantage of grip tape or other friction-surface material disposed on the surface of the skateboard.

In the following description, numerous specific details are set forth in order to provide a thorough understanding of the present invention. It will be apparent, however, to one skilled in the art that the present invention may be practiced without some or all of these specific details. In other instances, well known process steps have not been described in detail in order not to unnecessarily obscure the present invention.

Figure 1A:
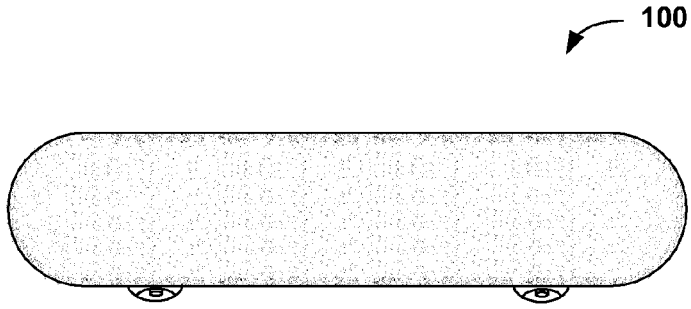
FIG. 1A is a diagram showing a top view of an exemplary flexible external surface shield disposed on a skateboard, in accordance with an embodiment of the present invention.

FIG. 1A is a diagram showing a top view of an exemplary flexible external surface shield 100 disposed on a skateboard, in accordance with an embodiment of the present invention. As mentioned above, a skateboard generally includes a 6-12 inch wide board or platform to stand upon that is 2-3 feet long. The board section often is made of wood or fiberglass materials and is coupled to trucks and wheels frequently comprised of polyurethane or other relatively soft rubber compounds.

Figure 1B:
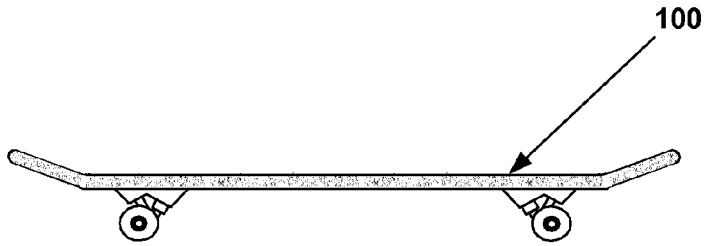
FIG. 1B is a diagram showing a side view of an exemplary flexible external surface shield disposed on a skateboard, in accordance with an embodiment of the present invention.

FIG. 1B is a diagram showing a side view of an exemplary flexible external surface shield 100 disposed on a skateboard, in accordance with an embodiment of the present invention. As illustrated in FIG. 1A and FIG. 1B, the flexible external surface shield 100 is disposed on the top surface of the board section of the skateboard. As mentioned above, the flexible external surface shield 100 allows a skateboard to be safely and comfortable used by a barefoot rider. Further, the flexible external surface shield 100 allows for comfort and heat protection and provides an attractive board surface. Moreover, the flexible external surface shield 100 is removably attached to allow riders having appropriate foot wear to take full advantage of grip tape or other friction-surface material disposed on the surface of the skateboard, as illustrated next with reference to FIG. 1C.

Figure 1C:
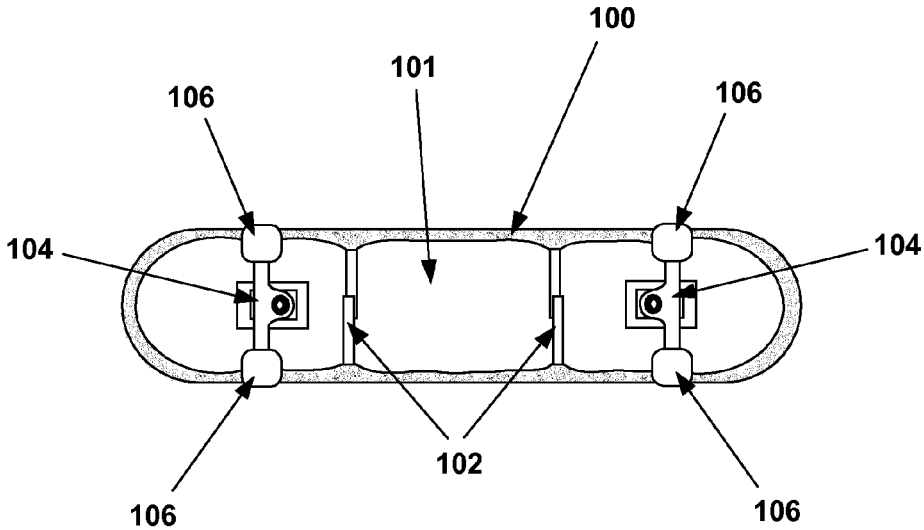
FIG. 1C is a diagram showing a bottom view of an exemplary flexible external surface shield disposed on a skateboard, in accordance with an embodiment of the present invention.

FIG. 1C is a diagram showing a bottom view of an exemplary flexible external surface shield 100 disposed on a skateboard 101, in accordance with an embodiment of the present invention. FIG. 1C illustrates one embodiment wherein the flexible external surface shield 100 is attached to the board section of the skateboard 101 via fasteners 102. In this manner, the flexible external surface shield 100 can be easily removed and replaced, avoiding other mechanisms present on the skateboard 101. For example, the skateboard 101 includes two trucks 104 and four wheels 106. A truck 104 typically includes a pivoting assembly with a single or split axle. Each truck assembly 104 is mounted on the bottom side of the board 101, with one truck assembly attached toward the front end of the skateboard and the other truck assembly attached toward the rear end of the skateboard.

As discussed above, the flexible external surface shield 100 is attached to the board section of the skateboard 101 via fasteners 102. More specifically, one embodiment of the present invention includes stretchable material, such as elastic, which is utilized to allow a portion of the flexible external surface shield 100 to wrap around the bottom portion of the skateboard 101. That is, the stretchable material is disposed in a casting and is capable of creating an inward force on the casting such that the casting forms an edge of an underside opening partially enclosing the lower surface of the board 101. In this manner, the flexible external surface shield 100 has increased stability to maintain shape and position on the surface of the skateboard. When the fasteners 102 are released, the flexible external surface shield 100 can be removed from the skateboard 101, as illustrated next with reference to FIG. 2A.

Figure 2A:
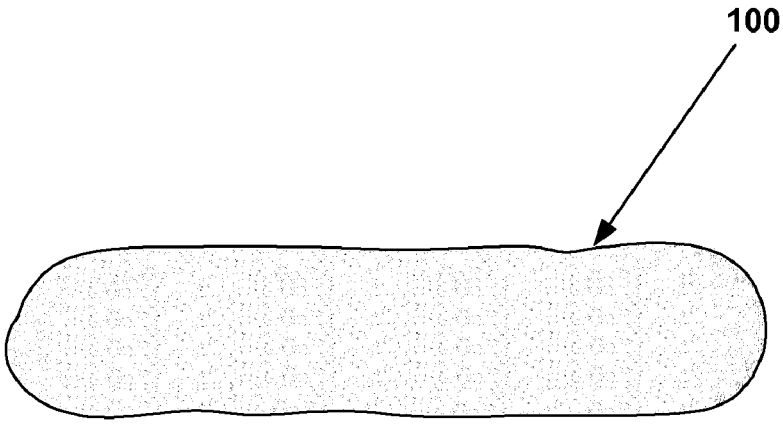
FIG. 2A is a diagram showing a top surface of an exemplary flexible external surface shield when removed from a skateboard, in accordance with an embodiment of the present invention.

FIG. 2A is a diagram showing a top surface of an exemplary flexible external surface shield 100 when removed from a skateboard, in accordance with an embodiment of the present invention. In one embodiment, the flexible external surface shield 100 is formed to fit the board of the skateboard. However, because of the flexibility of the material utilized in the construction of the flexible external surface shield 100, generally an embodiment of the flexible external surface shield 100 can be utilized with a variety of board shapes depending on the extents of board shape variation.

Figure 2B:
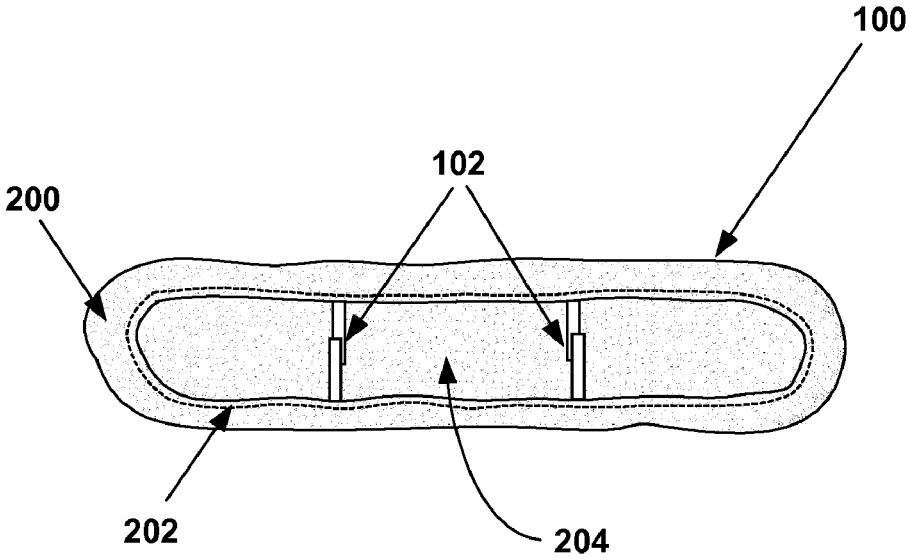
FIG. 2B is a diagram showing a bottom surface of an exemplary flexible external surface shield when removed from a skateboard, in accordance with an embodiment of the present invention.

FIG. 2B is a diagram showing a bottom surface of an exemplary flexible external surface shield 100 when removed from a skateboard, in accordance with an embodiment of the present invention. As mentioned above, one embodiment of the present invention includes stretchable material, such as elastic, which is utilized to allow a portion of the flexible external surface shield 100 to wrap around the bottom portion of the skateboard 101. Hence, the stretchable material is disposed in a casting 202 and is capable of creating an inward force on the casting such that the casting 202 forms an edge of an underside opening partially enclosing the lower surface of the basic shape of the flexible external surface shield 100.

For example, FIG. 2B illustrates one embodiment wherein a wrapping portion 200 of the flexible external surface shield 100 is designed to wrap around the bottom portion of a skateboard. The wrapping portion 200 of the flexible external surface shield 100 includes a stretchable material to assist in keeping the flexible external surface shield 100 attached to a skateboard. The stretchable material frames an underside opening 204 utilized to insert the board portion of a skateboard into the flexible external surface shield 100.

In addition, fasteners 102 are included to provide a further attachment mechanism to hold the flexible external surface shield 100 in position when attached to a skateboard. The fasteners are disposed across the underside opening of the flexible external surface shield 100, and prevent the underside opening from enlarging beyond a predetermined size when the fasteners are engaged. In the embodiment illustrated in FIG. 2B, the fasteners 102 are formed from hook & loop material which forms a relatively strong hold when set in place. However, it should be noted that any suitable material can be utilized in the construction of the fasteners, such as buckles, clamps, slider buckles, D-rings, webbing straps, and any other material suitable for forming a hold on the underside of a skateboard as will be apparent to those skilled in the art with the hindsight provided via a careful reading of the present disclosure.

Figure 3:
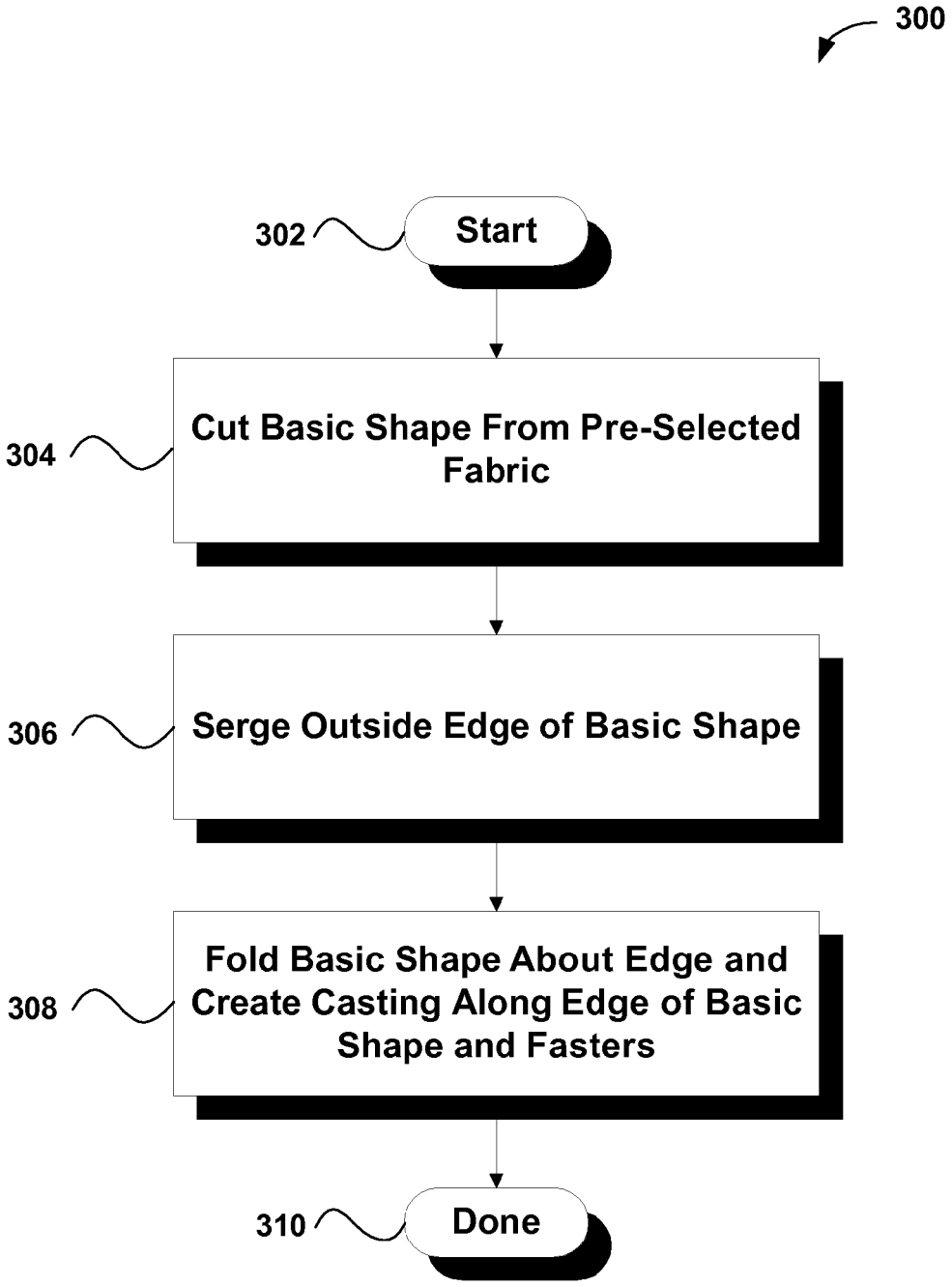
FIG. 3 is a flowchart showing a method for making a flexible external surface shield, in accordance with an embodiment of the present invention.

FIG. 3 is a flowchart showing a method 300 for making a flexible external surface shield 100, in accordance with an embodiment of the present invention. In an initial operation 302, preprocess operations are performed. Preprocess operations can include, for example, choosing a material from which to form the flexible external surface shield, selecting the particular shape of the flexible external surface shield based on a target skateboard shape, an other preprocess operations that will be apparent to those skilled in the art after a careful reading of the present disclosure.

Figure 4:
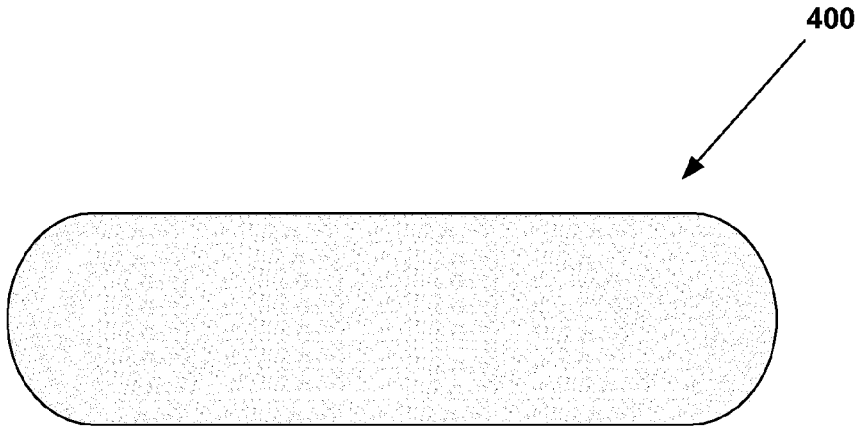
FIG. 4 is a diagram showing a basic shape for a flexible external surface shield cut from a pre-selected fabric, in accordance with an embodiment of then present invention.

In operation 304, a basic shape is cut from a portion of a pre-selected fabric based on the shape of a target skateboard. FIG. 4 is a diagram showing a basic shape 400 for a flexible external surface shield cut from a pre-selected fabric, in accordance with an embodiment of then present invention. In one embodiment, the basic shape 400 is shaped generally similar to the top surface shape of the target skateboard. However, in order to form an underside opening, as will be described in greater detail subsequently, the basic shape 400 is cut to be larger than the final shape of the flexible external surface shield. In one embodiment, the basic shape 400 is approximately 2½ inches larger than the top surface of the target skateboard. However, it should be noted that the basic shape 400 can be of any size suitable for generating a flexible external surface shield having an underside opening, as will be apparent to those skilled in the art with the hindsight provided by a careful reading of the present disclosure. One embodiment of the present invention is cut from a terrycloth material so as to be comfortable and durable for during use without shoes. However, it should be noted that embodiments of the present invention can be formed from any suitable material such as fleece, canvas, or other polyester or cotton material.

Figure 5:
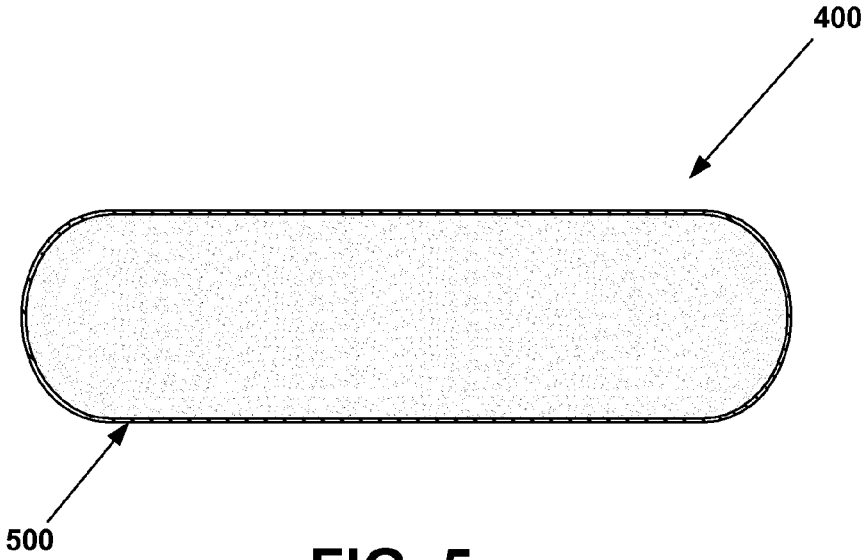
FIG. 5 is a diagram showing a basic shape having a serge stitch applied to the edge of the basic shape, in accordance with an embodiment of the present invention.

Referring back to FIG. 3, a serge stitch is applied to the edge of the basic shape once the basic shape is cut from the pre-selected material, in operation 306. FIG. 5 is a diagram showing a basic shape 400 having a serge stitch 500 applied to the edge of the basic shape 400, in accordance with an embodiment of the present invention. A serge stitch is an overlooking stitch that encloses the edge in a thread casing to prevent a fabric from raveling. In this manner, the edge of the basic shape 400 is provided with a finished look and made more durable.

Figure 6:
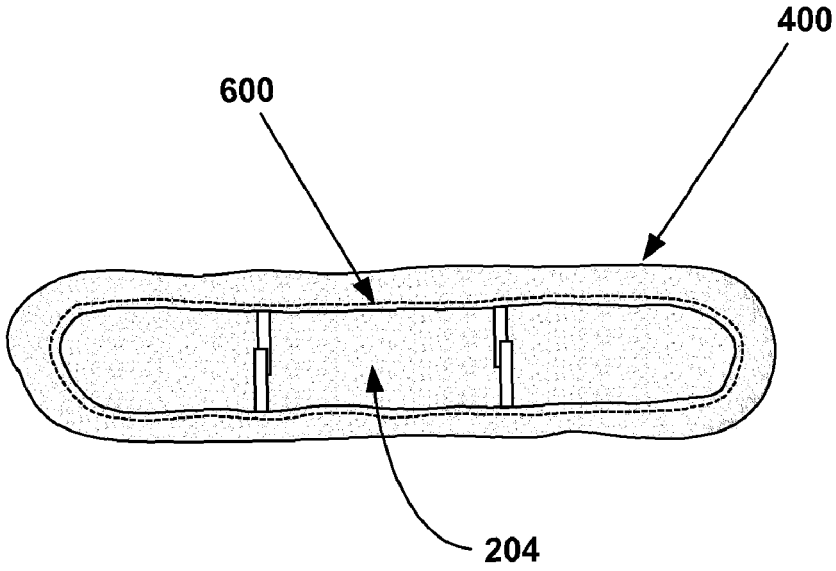
FIG. 6 is a diagram showing the basic shape having a casting along the edge of the fabric, in accordance with an embodiment of the present invention.

Turning back to FIG. 3, the edge of the basic shape is folded and a casting is created along the edge of the folded basic shape, in operation 308. FIG. 6 is a diagram showing the basic shape 400 having a casting 600 along the edge of the fabric, in accordance with an embodiment of the present invention. The casting 600 forms a fabric "tunnel" in which a stretchable material, such as an elastic band, is pulled through to create a stretchable tension that forms an underside opening 204 for the flexible external surface shield, as illustrated in greater detail in FIG. 7.

Figure 7:
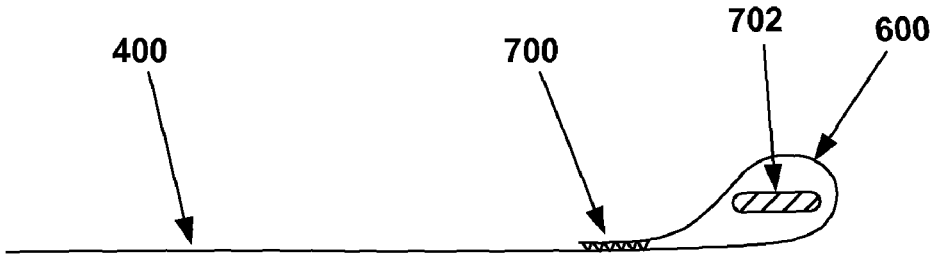
FIG. 7 is a diagram showing a cross-sectional view of a casting, in accordance with an embodiment of the present invention.

FIG. 7 is a diagram showing a cross-sectional view of a casting 600, in accordance with an embodiment of the present invention. The casting 600 is formed by folding the edge of the basic shape 400 and sewing a straight stitch 700 over the previously applied serge stitch. In addition, a stretchable material such as an elastic band 702 is inserted into the casting 600. In one embodiment, the elastic band 702 is fed through the casting opening along the edge of the basic shape 400. Generally the elastic band 702 is selected such that the length of the elastic band 702 is shorter than the circumference of the outer edge of the basic shape 400. In this manner, when the elastic band 702 is fed through the casting opening along the edge of the basic shape and reconnected to itself, the elastic band causes the basic shape 400 to fold in on itself to form an underside opening 204, as illustrated in FIG. 6. Although FIG. 6 and FIG. 7 illustrates utilizing a stretchable material inside the casting, it should be noted that any material can be utilized that allows the casting to be pulled in an inward direction, such as a pull cord.

Referring back to FIG. 3, fasteners also can be attached to the edge of the casting in operation 308. In one embodiment, the fasteners are formed from hook & loop material. However, it should be noted that the fasteners can be formed from a plurality of different materials, as described previously, depending on the design needs of the user and/or manufacturer. Hence, in this embodiment, the fasteners can be attached using the straight stitch along the edge of the casting.

Post process operations are performed in operation 310. Post process operations can include, for example, application of decorations or logos on the surface of the flexible external surface shield, testing, and other post process operations that will be apparent to those skilled in the art with the hindsight provided by a careful reading of the present disclosure. In this manner, embodiments of the present invention can be manufactured to allow a skateboard to be safely and comfortable used by a barefoot rider.

The flexible external surface shield allows for comfort and heat protection and provides an attractive board surface. Moreover, the flexible external surface shield is removably attached to allow riders having appropriate foot wear to take full advantage of grip tape or other friction-surface material disposed on the surface of the skateboard. In addition, the flexible external surface shield can be included added protection from the skateboard wheels during severe board operation or when utilized with long boards, as described next with reference to FIG. 8.

Figure 8:
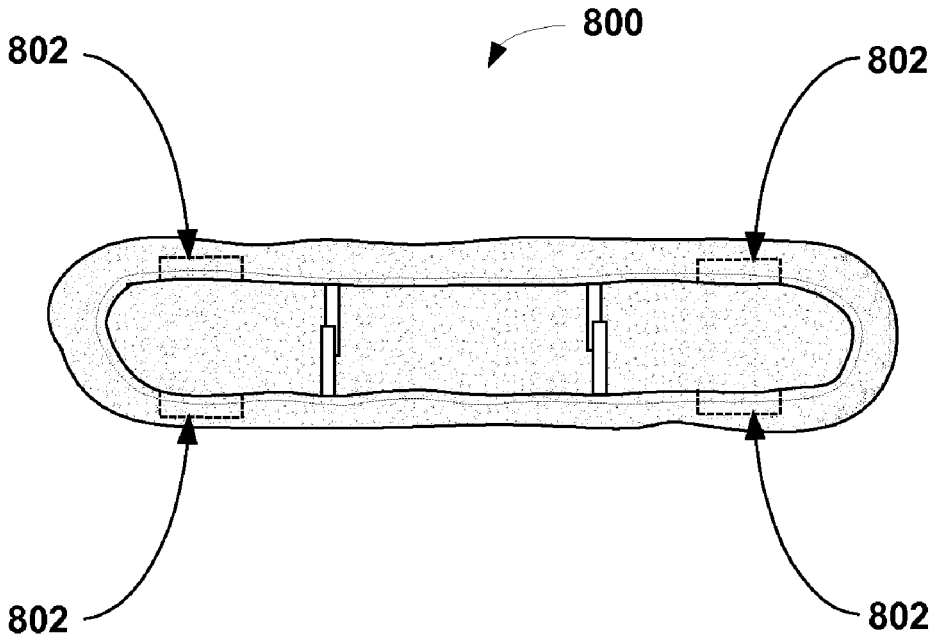
FIG. 8 is a diagram showing a flexible external surface shield having wheel protectors, in accordance with an embodiment of the present invention.

FIG. 8 is a diagram showing a flexible external surface shield 800 having wheel protectors 802, in accordance with an embodiment of the present invention. In some circumstances a skateboard can be operated in such a manner that the board section of the skateboard comes into contact with the wheels of the skateboard, such as when "carving" to perform tight turns. To provide added protection against damage during such use, embodiments of the present invention can include wheel protectors 802. In one embodiment, the wheel protectors 802 comprise a boning that is applied to the flexible external surface shield 800 in the vicinity of the trucks and wheels. Generally the boning is attached to the flexible external surface shield 800 on the side of the fabric opposite the surface facing the trucks and wheels. In this manner, the boning prevents the fabric from gathering when contacted by a rotating wheel. In a further embodiment, the wheel protectors can be a hard material attached in the vicinity of the trucks and wheels on the same side of the fabric surface facing the wheels. In this embodiment, the wheels will contact the hard material, which typically can withstand the friction of the contact.

It should be further borne in mind that embodiments of the present invention can also be utilized on miniature skateboards, often utilized for decoration, desk recreation, or other uses as will be apparent to those skilled in the art after the hindsight afforded after a careful reading of the present disclosure. In such uses, embodiments of the present invention can provide attractive covers to miniature skateboards for added comfort when operated via a users hands, and as protective shields for storage and other uses.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A flexible external surface shield for use while operating a recreational board, comprising:

a shaped material having an outer edge, an upper surface, and a lower surface;

a casting formed along the outer edge, the casting including a stretchable material capable of creating an inward force on the casting, wherein the casting forms an edge of an underside opening partially enclosing the lower surface of the shaped material;

a plurality of fasteners disposed across the underside opening, wherein the fasteners are capable of preventing the underside opening from enlarging beyond a predetermined size when the fasteners are engaged; and a plurality of wheel protectors disposed in a vicinity of wheels when utilized with a skateboard, each wheel protector being capable of preventing a portion of damage from wheels contacting the flexible external surface shield.

2. A flexible external surface shield as recited in claim 1, wherein the stretchable material is an elastic band.

3. A flexible external surface shield as recited in claim 1, wherein the shaped material comprises a terrycloth fabric.

4. A flexible external surface shield as recited in claim 1, wherein the fasteners are hook and loop fasteners.

5. A flexible external surface shield as recited in claim 1, wherein each wheel protector is formed from a boning material.

6. A flexible external surface shield for use while operating a recreational board, comprising:

a shaped material having an outer edge, an upper surface, and a lower surface;

a casting formed along the outer edge, the casting including a pull cord capable of creating an inward force on the casting when placed in a tightened position, wherein the casting forms an edge of an underside opening partially enclosing the lower surface of the shaped material;

a plurality of fasteners disposed across the underside opening, wherein the fasteners are capable of preventing the underside opening from enlarging beyond a predetermined size when the fasteners are engaged; and a plurality of wheel protectors disposed in a vicinity of wheels when utilized with a skateboard, each wheel protector being capable of preventing a portion of damage from wheels contacting the A flexible external surface shield.

7. A flexible external surface shield as recited in claim 6, wherein the shaped material comprises a terrycloth fabric.

8. A flexible external surface shield as recited in claim 6, wherein the shaped material comprises a fleece fabric.

9. A flexible external surface shield as recited in claim 6, wherein the fasteners are hook and loop fasteners.

10. A flexible external surface shield as recited in claim 6, wherein each wheel protector is formed from a boning material.

* * * * *